US010441836B1

(12) United States Patent
Fairhurst

(10) Patent No.: US 10,441,836 B1
(45) Date of Patent: Oct. 15, 2019

(54) COMBINATION TOWEL-BAND EXERCISE DEVICE

(75) Inventor: Angela L. Fairhurst, Los Angeles, CA (US)

(73) Assignee: Fairhurst Productions, Inc., Los Angeles, CA (US)

( * ) Notice: Subject to any disclaimer, the term of this patent is extended or adjusted under 35 U.S.C. 154(b) by 532 days.

(21) Appl. No.: 11/900,821

(22) Filed: Sep. 12, 2007

Related U.S. Application Data

(60) Provisional application No. 60/845,000, filed on Sep. 15, 2006.

(51) Int. Cl.
*A63B 21/055* (2006.01)
*A63B 21/02* (2006.01)
*A63B 21/00* (2006.01)

(52) U.S. Cl.
CPC ..... *A63B 21/0552* (2013.01); *A63B 21/02* (2013.01); *A63B 21/055* (2013.01); *A63B 21/0557* (2013.01); *A63B 21/4015* (2015.10); *A63B 21/4019* (2015.10); *A63B 21/4033* (2015.10); *A63B 21/4035* (2015.10); *A63B 21/4037* (2015.10); *A63B 2208/0204* (2013.01)

(58) Field of Classification Search
CPC ... A63B 21/055; A63B 21/0552; A63B 21/02; A63B 21/0555; A63B 21/0557; A63B 21/04; A63B 21/0407; A63B 21/0442
USPC ..... 482/126, 74, 124, 103, 121, 122, 131, 482/139, 92; 401/201; D06/608, D06/601.596–603, 588; 15/208–209.1; 5/485, 489–491, 494–502, 417–420, 907; 428/78; D20/500; D24/189
See application file for complete search history.

(56) References Cited

U.S. PATENT DOCUMENTS 843,478 A * 2/1907 Muller ..... 482/124
1,922,169 A * 8/1933 Martin ..... 15/222
1,952,750 A * 3/1934 Gailey ..... A63B 21/023 482/125
1,990,568 A * 2/1935 Scheidler ..... 15/222
(Continued)

OTHER PUBLICATIONS http://www.livestrong.com/article/361972-what-is-the-official-size-of-the-nfl-football/, last visited Sep. 9, 2015.*

*Primary Examiner* — Joshua Lee
(74) *Attorney, Agent, or Firm* — Haverstock & Owens LLP

(57) ABSTRACT

A combination towel-band exercise device is able to be used to exercise and as a towel. A shammy or towel is available to dry off perspiration, provide a soft surface for a user to sit and stand, and integrated exercise bands are utilized for exercising. When a user wants to exercise, particularly while away from home such as at a gym, the beach or pool, the user is able to exercise with the combination towel-band exercise device. By providing weight on the shammy, the bands which are coupled to opposing ends of the shammy stretch as a user pulls the bands upward or outward. The weight is provided by a user's feet, buttocks, back or other body part. In addition to the combination towel-band exercise device being an exercise tool, it is also able to function as a towel. Therefore, if a user is at a gym or other exercise facility and needs to wipe perspiration off the equipment or herself, the shammy is available. Furthermore, if a user goes to the beach or pool, the shammy is able to be used as a beach towel for sitting, lying down and drying off. The combination towel-band exercise device is able to come in different lengths as well as in different tensions.

20 Claims, 5 Drawing Sheets

(56) References Cited

U.S. PATENT DOCUMENTS 2,035,014 A * 3/1936 Schaefer ..... 401/201
2,783,474 A * 3/1957 Campagna et al. ..... 2/171
3,130,441 A * 4/1964 Hahn ..... 401/201
3,227,450 A * 1/1966 Pruitt ..... A63B 67/10 473/426
3,364,511 A * 1/1968 Martin ..... 15/222
3,529,820 A * 9/1970 Templeton ..... 482/122
3,860,349 A * 1/1975 Scott ..... 401/8
3,875,933 A * 4/1975 Schwab ..... 601/143
4,073,490 A * 2/1978 Feather ..... A61H 11/00 482/129
4,090,706 A * 5/1978 Reda ..... 482/122
4,314,697 A * 2/1982 Brumfield et al. ..... 482/123
4,337,938 A * 7/1982 Rodriguez ..... 482/74
4,422,205 A * 12/1983 Braxter, Sr. ..... 15/222
D276,553 S * 11/1984 Landes ..... D24/214
4,672,707 A * 6/1987 Johnson ..... 15/222
4,824,105 A * 4/1989 Goldenberg ..... 482/113
4,991,840 A * 2/1991 Patton ..... A63B 69/0084 473/426
5,013,171 A * 5/1991 Almond, II ..... 401/6
D318,972 S * 8/1991 Chestnut ..... D6/608
5,076,574 A * 12/1991 Johnson, Jr. ..... 482/37
5,076,576 A * 12/1991 Johnston ..... 482/95
5,205,803 A * 4/1993 Zemitis ..... 482/121
5,251,990 A * 10/1993 Vought et al. ..... 401/8
5,295,949 A * 3/1994 Hathaway ..... 602/18
5,545,456 A * 8/1996 Suida ..... 428/76
5,556,368 A * 9/1996 Akin ..... 482/124
D380,119 S * 6/1997 Gonzalez ..... D6/608
D381,545 S * 7/1997 Muttick et al. ..... D6/608
5,681,248 A * 10/1997 Vani ..... 482/126
D385,743 S * 11/1997 Eldridge ..... D6/608
5,724,698 A * 3/1998 Mondragon ..... 15/209.1
5,743,478 A * 4/1998 Plestan ..... 242/231
5,743,838 A * 4/1998 Willis ..... A63B 21/0552 482/124
D401,201 S * 11/1998 Saleen ..... D12/192
5,857,948 A * 1/1999 Barnett ..... A63B 21/0004 482/140
D412,365 S * 7/1999 Szabo ..... D24/214
5,945,060 A * 8/1999 Williams ..... 264/564
D414,645 S * 10/1999 Cooper ..... D6/608
5,979,006 A * 11/1999 Stokes et al. ..... 15/222
5,983,436 A * 11/1999 Mason et al. ..... 15/222
D438,577 S * 3/2001 Phillips ..... D21/662
6,223,382 B1 * 5/2001 Schwab ..... 15/222
6,227,742 B1 * 5/2001 Corn et al. ..... 401/201
6,244,998 B1 * 6/2001 Hinds ..... 482/126
6,499,901 B1 * 12/2002 Rabbani ..... 401/201
6,505,367 B2 * 1/2003 Griffin et al. ..... 5/655
6,544,152 B2 * 4/2003 Rosati ..... 482/126
6,629,912 B2 * 10/2003 Downs ..... 482/124
6,692,415 B1 * 2/2004 Winston ..... 482/126
6,849,055 B1 * 2/2005 Williams ..... 601/137
7,101,325 B2 * 9/2006 Rigouby ..... 482/126
D533,308 S * 12/2006 Kovac ..... D28/63
7,175,576 B2 * 2/2007 Felberg et al. ..... 482/140
7,217,227 B2 * 5/2007 Finn ..... A63B 21/00181 482/129
7,217,228 B2 * 5/2007 Marquez ..... 482/130
D591,548 S * 5/2009 LaFratta ..... D6/608
D604,897 S * 11/2009 Ponce et al. ..... D28/7
2002/0187884 A1 * 12/2002 McGrath ..... A63B 21/0552 482/121
2004/0211798 A1 * 10/2004 Schechter ..... 224/222
2005/0194502 A1 * 9/2005 Montgomery ..... 248/174
2005/0205456 A1 * 9/2005 Meyer ..... A63B 57/60 206/525
2005/0239604 A1 * 10/2005 Denham ..... 482/23
2005/0271857 A1 * 12/2005 Brody ..... A63B 21/0004 428/78
2006/0063651 A1 * 3/2006 Sload ..... A63B 21/0004 482/124
2007/0287614 A1 * 12/2007 Fuller ..... A63B 21/00043 482/121
2008/0108482 A1 * 5/2008 Macey ..... 482/23
2008/0214369 A1 * 9/2008 Mancini ..... 482/121
2009/0114228 A1 * 5/2009 Kirschner ..... 128/206.13
2009/0255060 A1 * 10/2009 Biggs ..... 5/417

* cited by examiner

COMBINATION TOWEL-BAND EXERCISE DEVICE

RELATED APPLICATION(S)

This application claims priority under 35 U.S.C. § 119(e) of the co-owned U.S. Provisional Patent Application, Ser. No. 60/845,000, filed Sep. 15, 2006, and entitled "SHAMMY BAND." The Provisional Patent Application, Ser. No. 60/845,000, filed Sep. 15, 2006, and entitled SHAMMY BAND" is also hereby incorporated by reference in its entirety.

FIELD OF THE INVENTION

The present invention relates to the field of exercise equipment. More specifically, the present invention relates to portable exercise equipment.

BACKGROUND OF THE INVENTION

There are many exercise products on the market today including free weights, exercise bands, exercise balls, the Pilates Magic Circle, the Ab-DOer®, the Ab Lounge® and even the Bean®. All of these devices provide some form of resistance to assist a user for exercising muscles of their body.

Free weights come in a variety of sizes ranging from 1 pound to 120 pounds and provide a way to perform exercise motions with additional weight. For example, a user simply pressing her arms over her head is an exercise which causes little strain and thus a minimal workout. However, if that same person is holding 30 pound free weights in each hand, the exercise becomes much more strenuous and provides a greater workout. One drawback of free weights is that they are bulky and difficult to carry around since they are made out of steel or some other heavy material. Thus, they are not a viable option for mobile exercise equipment.

Bungee cords are strands of elastic bands woven together to create a strong, flexible cable. The bungee cords have an initial length and are able to be stretched to an extended length by exerting energy to stretch the cords. Using the idea of bungee cords, exercise equipment has evolved into lighter weight and more portable devices.

Exercise bands have been developed in response to the need for portable exercise equipment. Exercise bands have handles attached at opposite ends of a single elastic band. The bands are made of a lightweight, elastic material and are able to stretch when the ends are pushed or pulled by a user. Since the exercise bands are elastic they are able to be compacted for easy transportation. To use an exercise band, a user must position the band so that it provides resistance. Generally, the user positions the band underneath a part of the user's body such as beneath the user's feet or buttocks. As the user pushes or pulls the band, it adds additional pressure and rubbing against the user. This puts the user in an uncomfortable position, particularly having to sit on an elastic band which is at times, painful.

The other equipment mentioned above also provides modified methods of exercising, whether it be sitting down in a lounge chair that collapses in the middle, lying down on a ball or sitting in an apparatus shaped like a bean. However, all of these products have their own limitations and do not provide certain benefits needed for a portable exercise device.

SUMMARY OF THE INVENTION

A combination towel-band exercise device is able to be used to exercise and as a towel. A shammy or towel is available to dry off perspiration, provide a soft surface for a user to sit and stand on, and integrated exercise bands are utilized for exercising. When a user wants to exercise, particularly while away from home such as at a gym, the beach or pool, the user is able to exercise with the combination towel-band exercise device. By providing weight on the shammy, the bands which are coupled to opposing ends of the shammy stretch as a user pulls the bands upward or outward. The weight is provided by a user's feet, buttocks, back or other body part. In addition to the combination towel-band exercise device being an exercise tool, it is also able to function as a towel. Therefore, if a user is at a gym or other exercise facility and needs to wipe perspiration off the equipment or herself, the shammy is available. Furthermore, if a user goes to the beach or pool, the shammy is able to be used as a beach towel for sitting, lying down and drying off. The combination towel-band exercise device is able to come in different lengths as well as in different tensions.

DETAILED DESCRIPTION OF THE PREFERRED EMBODIMENT

A combination towel-band exercise device combines multiple elements of exercising into one piece of equipment. A shammy or towel is available to dry off perspiration, and exercise bands are utilized for exercising. Furthermore, the shammy provides a smooth surface for a user to sit and stand on for providing resistance while using the exercise bands.

Figure 1A:
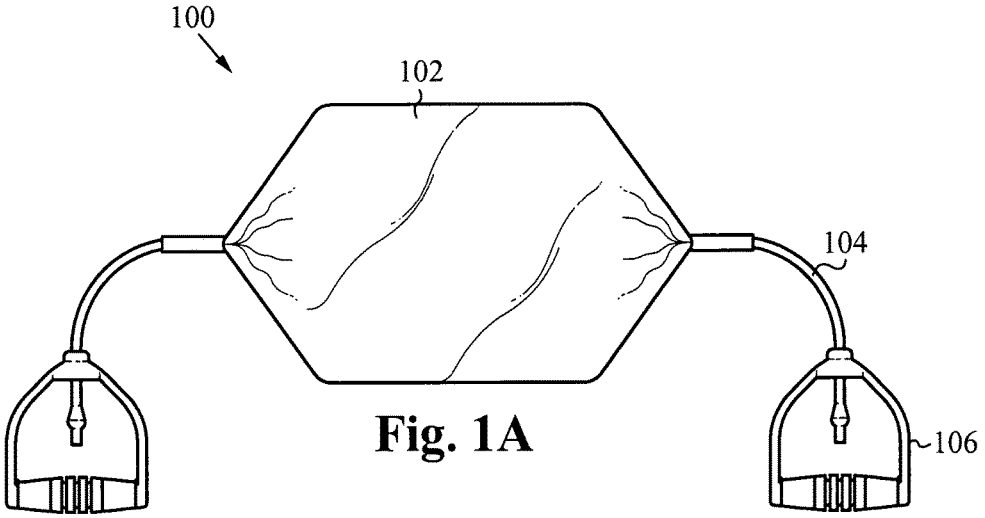
FIG. 1A illustrates a top perspective view of the preferred embodiment of the present invention.

FIG. 1A illustrates a top perspective view of the preferred embodiment of the present invention. A combination towel-band exercise device 100 includes a shammy 102 with elastic bands 104 coupled to opposing ends of the shammy 102. Coupled to the ends of the elastic bands 104 are handles 106. The shammy 102 is formed of any type of cloth that is able to absorb moisture such as a towel. The elastic bands 104 are elastic so that they are able to be stretched by force but then return to their original length when the force is released. Furthermore, as the elastic bands 104 are stretched further, the force pulling inward increases. For example, stretching the elastic bands 104 an additional six inches from their original length requires little effort, but stretching the elastic bands 104 an additional two feet requires significant effort by the user. The amount of effort required depends on the initial length of the elastic bands 104 as well. The elastic bands 104 are formed of a material such as rubber. Moreover, the elastic bands 104 are lightweight so that the combination towel-band exercise device 100 is easy to transport. The elastic bands 104 are a length that when unstretched are shorter than when being used. Additionally, the elastic bands 104 are a length that allows a user to perform desired exercises. Thus, not all combination towel-band exercise devices 100 are required to have the same length elastic bands 104. The elastic bands 104 are also able to vary in tension such as light, medium and heavy tension. A light band stretches with little force whereas a heavy band requires a user to exert more energy to stretch the band. By varying the tension, bands of the same length are able to provide different resistance. The handles 106 are constructed so that a user is able to comfortably grip them while exercising. In some embodiments, the handles 106 are ergonomically designed.

Figure 1B:
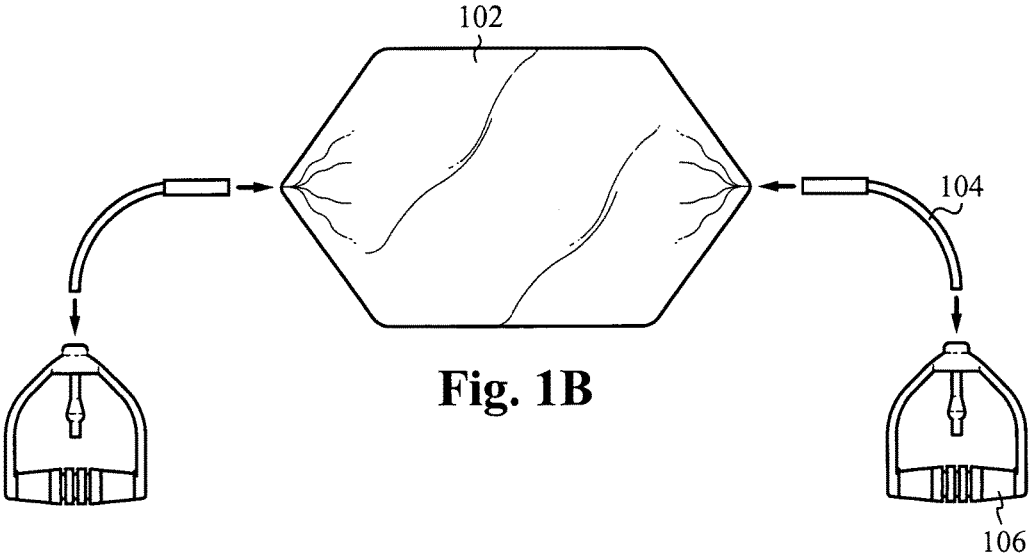
FIG. 1B illustrates a top perspective view of the components of the preferred embodiment of the present invention.

FIG. 1B illustrates a top perspective view of the components of the preferred embodiment of the present invention. The combination towel-band exercise device 100 is able to be constructed with a minimal number of components to minimize the total weight and to provide less opportunities for a component to tear or wear out. The elastic bands 104 couple to opposing ends of the shammy 102. In the preferred embodiment, the elastic bands 104 couple directly to the ends of the shammy 102. In some embodiments, a small portion of the elastic bands 104 are coupled within the towel instead of directly to the ends of the towel. The other ends of the elastic bands 104 are coupled to the handles 106. A beneficial feature of the combination towel-band exercise device 100 is that in the preferred embodiment, the elastic bands 104 do not go through the shammy 102 and only couple to the ends of the shammy 102. As described, previous elastic bands required a user to sit or stand on the actual elastic band which at times was very painful as the elastic would rub against or dig into a user's skin. By utilizing the present invention, the user sits, stands or lies on the shammy 102 of the combination towel-band exercise device 100, so that there is no uncomfortable band bothering the user.

Figure 1C:
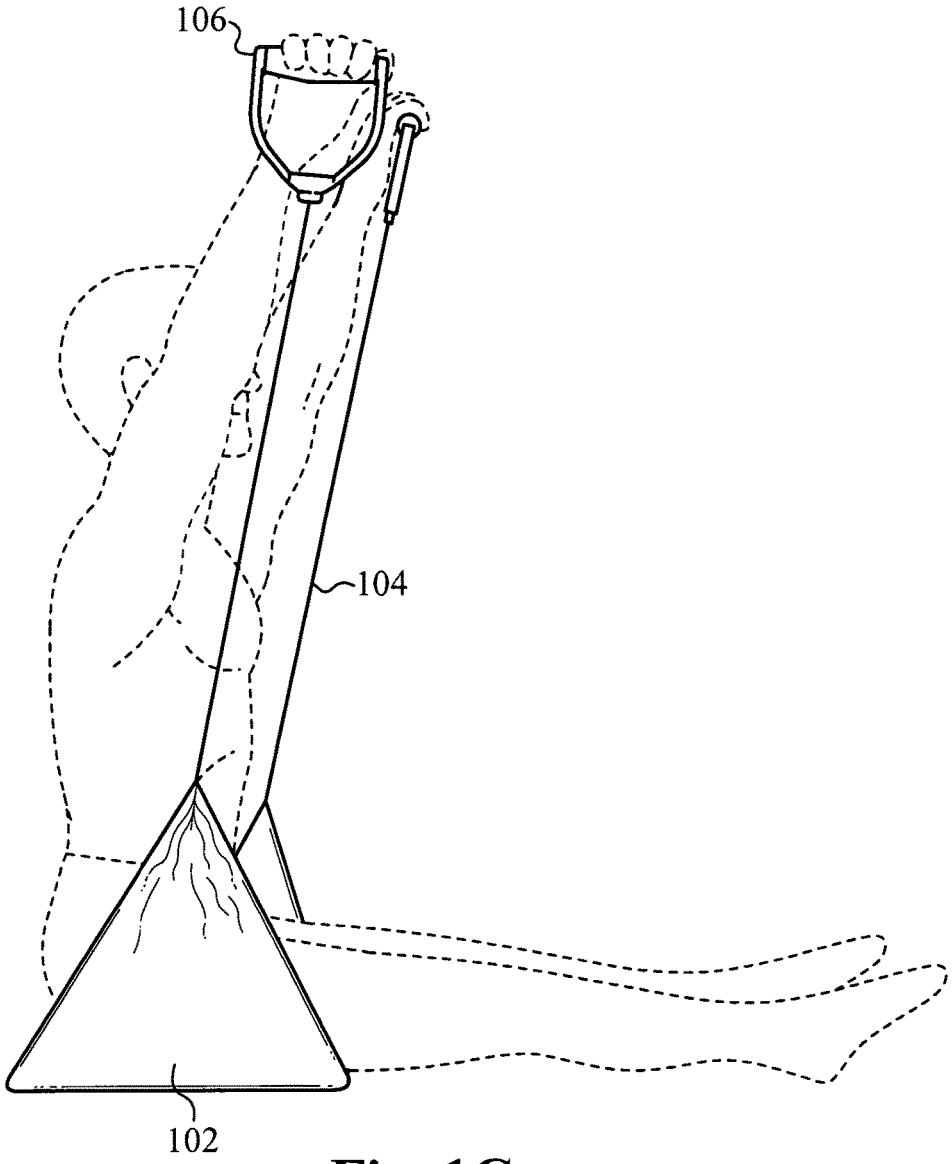
FIG. 1C illustrates a side perspective view of the preferred embodiment of the present invention in use.

FIG. 1C illustrates a side perspective view of the preferred embodiment of the present invention in use. A user is able to use the combination towel-band exercise device 100 by placing weight on the shammy 102, grasping the handles 106 and then moving the user's arms or body so that the elastic bands 104 expand and contract. By placing weight on the shammy 102 and moving the user's body such as the user's arms, the inward force of the elastic bands 104 provides resistance, so that the user's muscles are exercised. A user is able to place weight on the shammy 102 with her feet, buttocks, back, knees, side, abdomen or any other body part that is able to provide a counterweight to the pulling or pushing of the user's muscles. Using the combination towel-band exercise device 100, a user is able to perform a wide variety of exercises. For example, depending on the user's position, the user is able to do shoulder presses, shrugs, upright rows, curls, triceps exercises, lateral raises, air punches, sit ups, bench presses, incline presses, butterflies, squats, lunges, calf raises and aerobic exercises in addition to any other exercise that is possible using elastic bands.

The combination towel-band exercise device 100 is able to be used as an exercise device, but the combination towel-band exercise device 100 is also fully functional as a towel to absorb perspiration and other liquids. For instance, many gyms require users to wipe down equipment after perspiring on it for sanitation reasons. The combination towel-band exercise device 100 is able to be used to wipe down the equipment. Furthermore, since the combination towel-band exercise device 100 is able to be incorporated into a user's workout at the gym, the user receives a dual benefit from the combination towel-band exercise device 100. Instead of simply using the combination towel-band exercise device 100 on the floor or ground, the combination towel-band exercise device 100 is able to be placed on a piece of equipment such as a bench or incline bench so the user is able to do slightly different exercises than those performed on the ground. Then after using the equipment with the combination towel-band exercise device 100, the user is able to clean the equipment.

Additionally, the combination towel-band exercise device 100 is able to be utilized with other exercise equipment, whereas a simple bungee cord would not suffice. For example, if a user has an exercise ball, a possible exercise is to lie with the user's back on the ball and do exercise motions with the user's arms using the combination towel-band exercise device 100. The ball is able to remain on the shammy 102 due to the shammy's increased surface area, unlike a single bungee cord which is very narrow and would likely slip out from under the exercise ball.

When people go to the beach, they inherently bring a beach towel to lie down on or to dry off after going into the water. The combination towel-band exercise device 100 is able to perform both of those functions. Moreover, if the user desires to do a workout while relaxing on the beach, it is possible with the combination towel-band exercise device 100, unlike a regular beach towel. Similarly, when people are at a pool, park, yard or anywhere that they sit, lie on or otherwise use a towel, the combination towel-band exercise device 100 is able to be used and provides a soft surface for a user to sit, stand or lie on.

In some embodiments, the towel is super-absorbent and therefore thinner than a typical heavy towel. In some embodiments, the towel also includes elastic properties.

Figure 2:
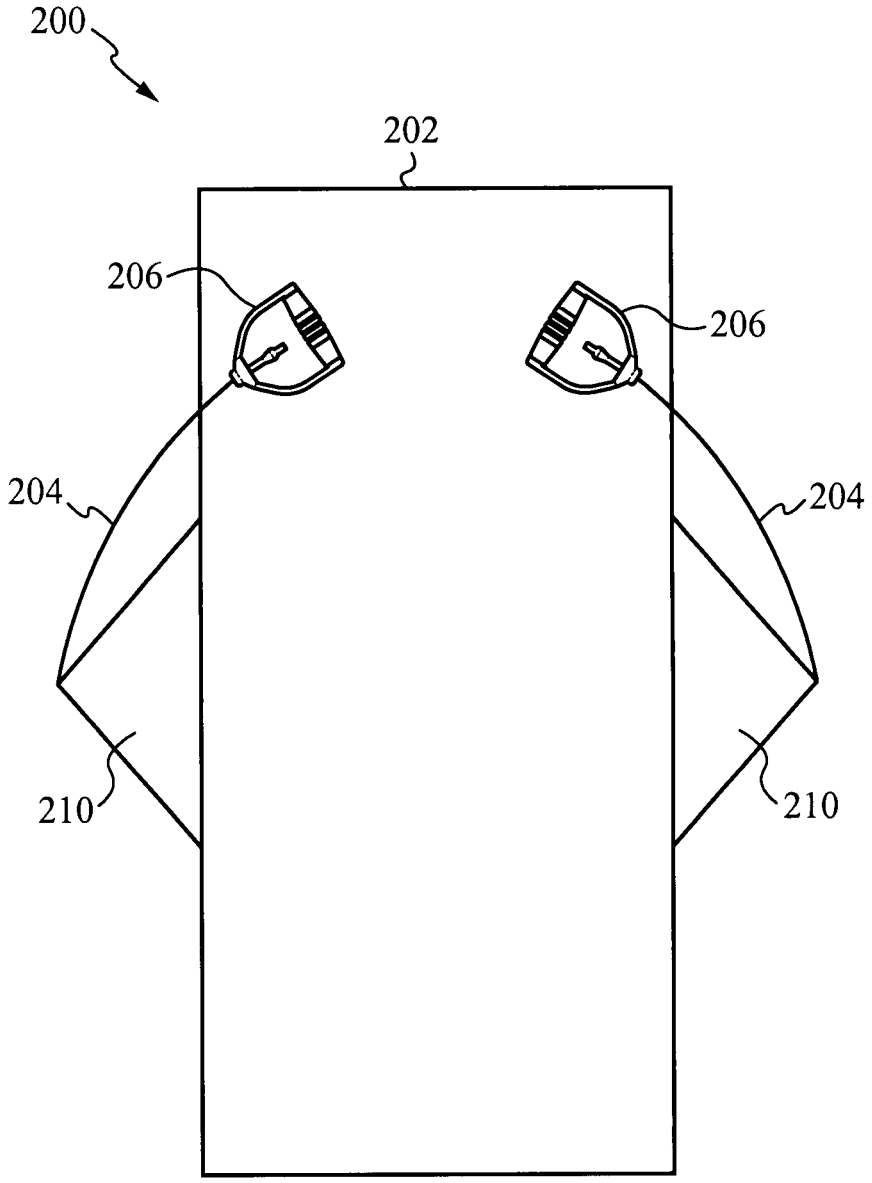
FIG. 2 illustrates a top perspective view of an alternative embodiment of the present invention.

FIG. 2 illustrates a top perspective view of an alternative embodiment of the present invention. A flapped combination towel-band exercise device 200 is similar to the combination towel-band exercise device 100 except that it includes an elongated shammy 202 and side flaps 210 which are coupled to the sides of the elongated shammy 202. The side flaps 210 are of the same material as the elongated shammy 202 such as a cloth material. Furthermore, the elastic bands 204 couple to the side flaps 210 instead of directly to the shammy in this embodiment. By providing additional side flaps 210 for the elastic bands 204 to couple to, the elongated shammy 202 is able to remain elongated and thus provide a larger surface area instead of being slightly smaller due to the coupling with the elastic bands 204. Also, similar to the preferred embodiment, the elastic bands 204 are coupled to the handles 206.

Figure 3:
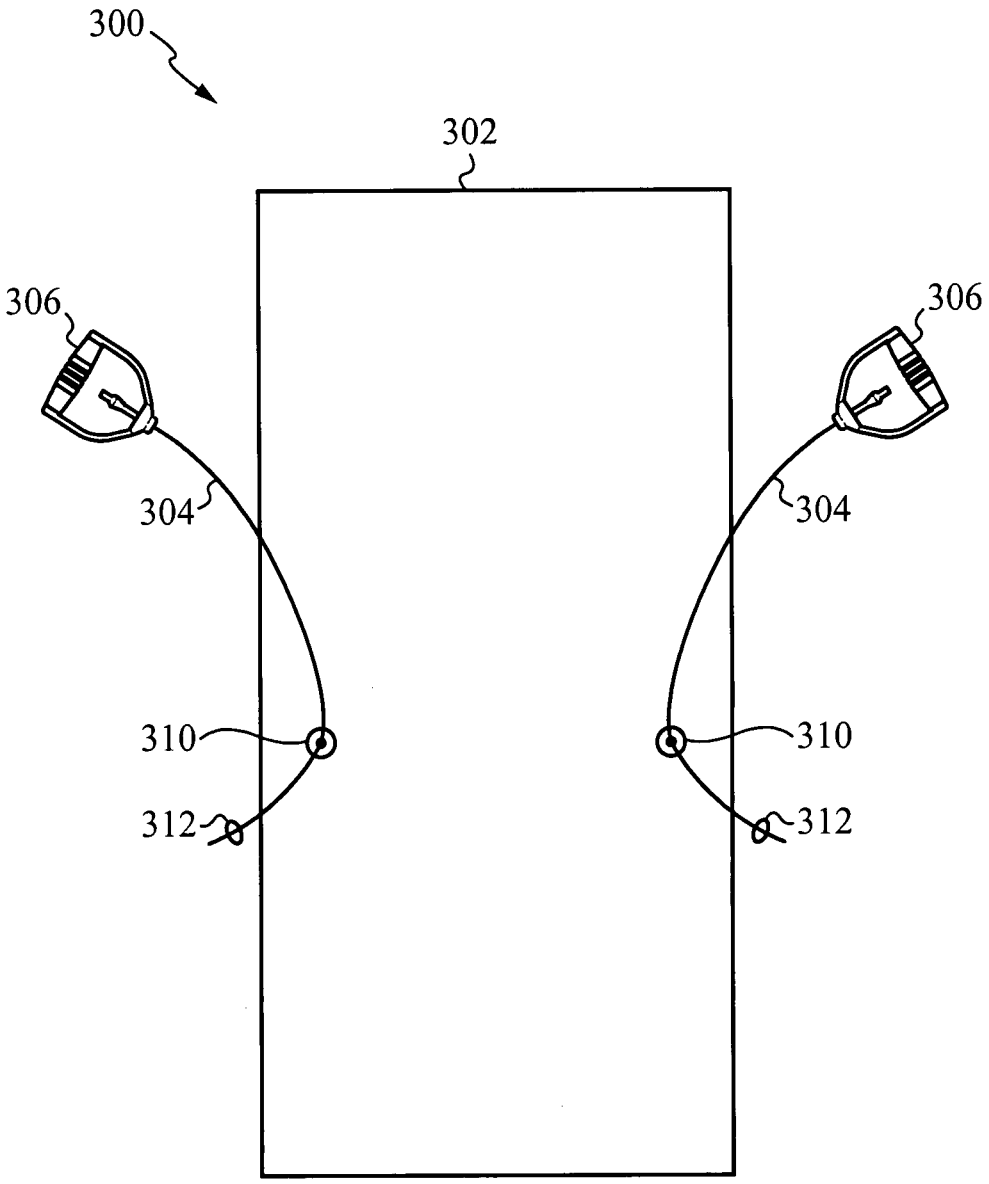
FIG. 3 illustrates a top perspective view of an alternative embodiment of the present invention.

FIG. 3 illustrates a top perspective view of an alternative embodiment of the present invention. In an alternative embodiment, a modifiable combination towel-band exercise device 300 includes a shammy 302. Handles 306 are coupled to the shammy 302 by modifiable elastic bands 304. The modifiable elastic bands 304 couple to the shammy 302 through apertures 310 and are each secured to the shammy 302 with a securing feature 312. The apertures 310 are generated within the shammy 302 in a manner so that the shammy 302 will not tear. For example, the apertures 310 are sewn within the shammy 302 by performing the proper stitching in the area. Another method of inserting apertures within the shammy 302 is by installing grommets. Any mechanism to securely place apertures 310 on opposing ends of the shammy 302 is possible. The apertures 310 are sized sufficiently to receive the elastic bands 304. The securing features 312 then secure each of the elastic bands 304 by preventing the ends of the elastic bands 304 from passing back through the apertures 310. The securing features 312 are able to be a knot, a clasp or any device that is able to prevent a band from passing through an aperture. Therefore, the securing features 312 are at least slightly larger than the apertures 310. Furthermore, the securing features 312 are able to be moved. By moving the securing features 312, the length of the elastic bands 304 is able to be modified. For example, if the securing features 312 are clasps, by moving the clasps closer to each of the ends of the elastic bands 304, the amount of elastic band that passes through the shammy 302 is as long as possible for those elastic bands. By moving the clasps further up the elastic bands 304 towards the handles 306, the elastic bands 304 become shorter. By modifying the length of the elastic bands 304, a user is able to perform different exercises as well as change the resistance in the bands.

Figure 4:
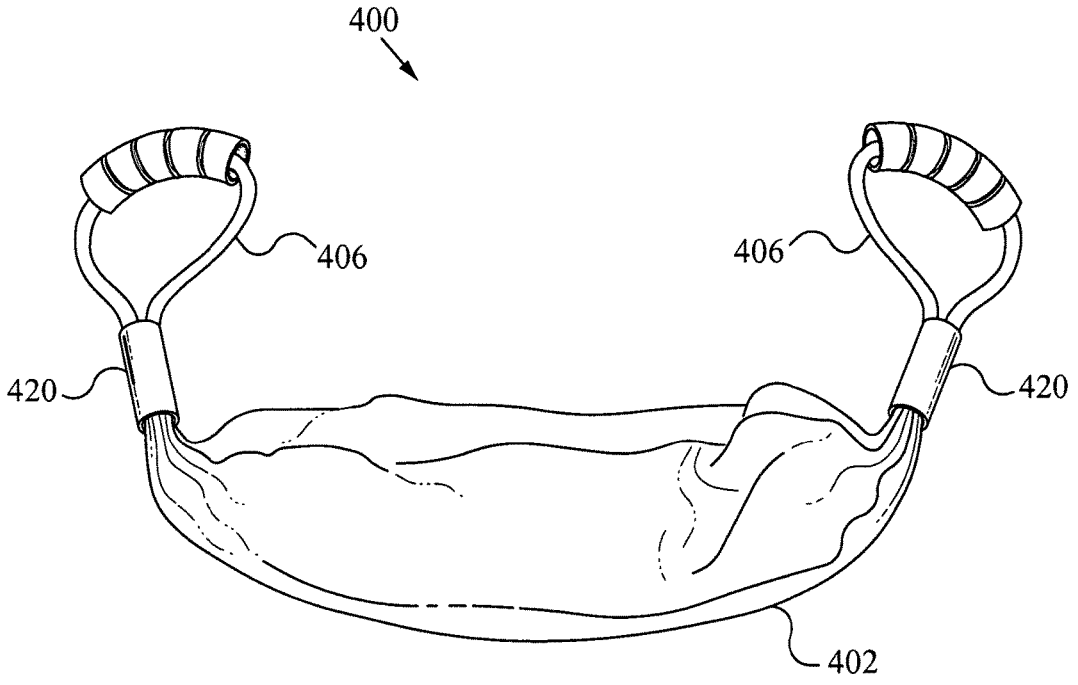
FIG. 4 illustrates a top perspective view of an alternative embodiment of the present invention.

FIG. 4 illustrates a top perspective view of an alternate embodiment of the present invention. A combination towel-band exercise device 400 includes a shammy 402 with elastic handles 406 coupled to opposing ends of the shammy 402 by the securing devices 420. On each end of the shammy 402, the securing device 420 secures both ends of an elastic band to the end of the shammy 402, thereby forming the elastic handle 406. In this embodiment, while pulling the elastic loop handle 406, two lengths of elastic bands are being pulled by the user while sitting, standing or lying on the shammy 402.

To utilize the combination towel-band exercise device, a user has many options. The combination towel-band exercise device is able to be utilized as an exercise device, a towel or both. As an exercise device, a user positions the combination towel-band exercise device to perform desired exercises. For some exercises, the user stands on the shammy, for other exercises the user sits on the shammy and for yet other exercises, the user positions the shammy elsewhere. After positioning the user's body properly, the user grasps the handles and performs movements that exercise the user's muscles. For example, if the user is sitting on the shammy and intends to exercise her shoulders, the user pushes the handles into the air, then brings the handles down and repeats. As another example, if the user is standing on the shammy and intends to perform squats, she grasps the handles and either holds them at her side with her arms straight down or at her shoulders with her arms bent. Then, the user slowly squats down and upon reaching a desired position, the user stands upright again. The user repeats this process for a desired number of repetitions. As described above, in addition to the combination towel-band exercise device being used for exercising, the user is also able to use the shammy to dry off.

In operation, the combination towel-band exercise device performs similarly to other elastic band exercisers with some important differences. The combination towel-band exercise device utilizes a shammy as the seat area which is also the counterpoint to whatever exercise motion the user is implementing. Thus, the user sits on a soft shammy as opposed to sitting on an elastic band. Furthermore, the shammy of the combination towel-band exercise device is able to be used as a towel to dry off either the user, equipment or other items.

The combination towel-band exercise device is able to be washed in a washing machine. In some embodiments, the towel is super-absorbent and therefore thinner than a typical heavy towel. In some embodiments, the towel also includes elastic properties.

In all embodiments, the shammy is able to be made of a stretchable material as well, so that in addition to the elastic bands being stretchable, the shammy is too. By providing a stretchable elastic shammy, this adds an element to a user's workout wherein the stretching of the shammy provides a different amount of resistance than the elastic bands. Both the shammy and the elastic bands are able to come in different lengths as well as in different tensions.

In alternative embodiments, it is possible for the above-mentioned embodiments to include elastic bands without handles, to provide an even lighter-weight and more compact combination towel-band exercise device. With such a modification, a user would simply grasp somewhere on the elastic bands.

In another alternative embodiment, only one elastic band is used, wherein each of the ends of the elastic band couples to a handle, and a shammy covers the midpoint of the elastic band. Additional shammy material or padding is provided around the elastic band so that the shammy is still comfortable for a user.

In an alternative embodiment, more than one band is coupled to each side of the shammy and to each of the handles. Furthermore, in an alternative embodiment, the number of bands coupled to each side of the shammy and to the handles is variable, so that a user utilizes one band for minimum resistance and adds subsequent bands to each side to provide greater resistance. The bands are able to be coupled to the shammy and handles in any manner that will securely couple the equipment together, yet provide easy configurability. For example, the shammy and the handles each have apertures, with or without grommets, and the bands have hooks for insertion into the apertures.

The term "shammy" used herein is meant to include towels, cloths, fabrics and other materials that are able to dry objects.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A combination towel-band exercise device comprising a plurality of separately movable bands for performing upper body exercises, the device comprising:

a. a rectangular shaped towel device usable as a seat and as a towel to absorb perspiration and other liquids and having a shammy and a plurality of apertures that pass through the shammy of the towel device;

b. the plurality of separately movable bands, each providing an increasing resistance as the band is extended and comprising a first end that passes through one of the plurality of apertures, wherein each of the one or more bands extends from an end of the towel device; and c. a plurality of handles separate and distinct from the plurality of separately movable bands, each handle attached at a second end opposite the first end of the plurality of separately movable bands for performing exercises by extending and retracting the plurality of separately movable bands with the handles, wherein the bands are extended and retracted when the towel-band exercise device is laid flat on a surface and weight is placed on the towel-band exercise device.

2. The exercise apparatus as claimed in claim 1 wherein the one or more bands are elastic.

3. The exercise apparatus as claimed in claim 1 wherein the one or more bands are comprised of rubber.

4. The exercise apparatus as claimed in claim 1 wherein the one or more bands are able to vary in tension.

5. A combination towel-band exercise device comprising a plurality of elastic bands for performing upper body exercises, the device comprising:

a. a rectangular shaped towel device usable as a seat and as a towel to absorb perspiration and other liquids and comprising a first towel end and a second towel end, wherein the first towel end and the second towel end are opposite ends;

b. a first flap and a second flap, wherein each of the flaps comprise a broad end and a narrow end opposite the broad end such that the flaps taper between the broad end and the narrow end, further wherein the broad end of the first flap is coupled to the first towel end of the towel device and the broad end of the second flap is coupled to the second towel end of the towel device;

c. the plurality of elastic bands, wherein the plurality of elastic bands provide an increasing resistance as the bands are extended, and wherein a first end of one of the bands is attached at the narrow end of the first flap opposite the towel device and a first end of one of the bands is attached at the narrow end of the second flap opposite the towel device for providing resistance, wherein the plurality of elastic bands extend directly from an end of the one or more flaps; and d. one or more handles separate and distinct from the plurality of elastic bands and coupled to the plurality of elastic bands for performing exercises by extending and retracting the plurality of elastic bands with the one or more handles, wherein the plurality of elastic bands are extended and retracted when the towel-band exercise device is laid flat on a surface and weight is placed on the towel-band exercise device, and wherein the one more handles are attached at a second end opposite the first end of the plurality of elastic bands.

6. The exercise apparatus as claimed in claim 5 wherein the towel device is elastic.

7. The exercise apparatus as claimed in claim 5 wherein the plurality of elastic bands are comprised of rubber.

8. The exercise apparatus as claimed in claim 5 wherein the plurality of elastic bands vary in tension.

9. A combination towel-band exercise device comprising a plurality of elastic bands for performing upper body exercises, the device comprising:

a. a rectangular shaped towel device usable as a seat and as a towel to absorb perspiration and other liquids comprising a first end and a second end, wherein the first end and the second end are opposite ends;

b. a first flap coupled to the first end of the towel device;

c. a second flap coupled to the second end of the towel device;

d. a first elastic band comprising a first elastic band first end attached at the first flap on a side of the first flap opposite the towel device and for providing an increasing resistance as the first elastic band is extended, and wherein the first elastic band extends directly from the first flap;

e. a second elastic band comprising a second elastic band first end attached at the second flap on a side of the second flap opposite the towel device and for providing an increasing resistance as the second elastic band is extended, and wherein the second elastic band extends directly from the second flap; and f. a first handle attached at a first elastic band second end opposite the first elastic band first end, wherein the first handle is separate and distinct from the first elastic band and a second handle attached at a second elastic band second end opposite the second elastic band first end, wherein the second handle is separate and distinct from the second elastic band and for performing exercises by extending and retracting the first elastic band with the first handle and by extending and retracting the second elastic band with the second handle, wherein the first elastic band and the second elastic band are extended and retracted when the towel-band exercise device is laid flat on a surface and weight is placed on the towel-band exercise device.

10. The exercise apparatus as claimed in claim 9 wherein the towel device is elastic.

11. The exercise apparatus as claimed in claim 9 wherein the first elastic band and the second elastic band are comprised of rubber.

12. The exercise apparatus as claimed in claim 9 wherein the first elastic band and the second elastic band vary in tension.

13. A combination towel-band exercise device comprising a plurality of elastic bands for performing upper body exercises, the device comprising:

a. a rectangular shaped towel device usable as a seat and as a towel to absorb perspiration and other liquids and containing a plurality of apertures that pass through the towel device;

b. the plurality of elastic bands comprising a first end attached at the towel device by passing through the plurality of apertures wherein the plurality of elastic bands provide an increasing resistance as the bands are extended;

c. one or more handles separate and distinct from the plurality of elastic bands and attached at a second end opposite the first end of the plurality of elastic bands for performing exercises by extending and retracting the plurality of elastic bands with the one or more handles, wherein the plurality of elastic bands are extended and retracted when the towel-band exercise device is laid flat on a surface and weight is placed on the towel-band exercise device; and d. a plurality of movable devices for securing the plurality of elastic bands to the towel and for preventing the bands from passing through the apertures, and which modify a length of the plurality of elastic bands.

14. The exercise apparatus as claimed in claim 13 wherein the plurality of apertures each include a grommet.

15. The exercise apparatus as claimed in claim 13, wherein the devices for securing are knots and are located at the ends of the bands opposite the handles.

16. The exercise apparatus as claimed in claim 13 wherein the movable devices are movable such that the devices are able to be positioned on different portions of the bands.

17. The exercise apparatus as claimed in claim 13 wherein a length of the bands that can protrude on either side of the apertures changes by moving the movable devices.

18. The exercise apparatus as claimed in claim 13 wherein the plurality of elastic bands vary in tension.

19. A combination towel-band exercise device comprising one or more elastic bands for performing upper body exercises, the device comprising:

a. a rectangular shaped towel device usable as a seat and as a towel to absorb perspiration and other liquids and having a surface area;

b. the one or more elastic bands comprising a first end attached directly through an end of the towel device and for providing an increasing resistance as the band is extended, wherein the one or more bands extend from the end of the towel device; and c. one or more handles attached at a second end opposite the first end of the one or more elastic bands wherein the one or more handles are separate and distinct from the one or more elastic bands and for performing exercises by extending and retracting the one or more bands with the one or more handles, wherein the one or more elastic bands are extended and retracted when the towel-band exercise device is laid flat on a surface and weight is placed on the towel-band exercise device.

20. A combination towel-band exercise device comprising one or more bands for performing upper body exercises, the device comprising:

a. a rectangular shaped elastic towel device usable as a seat and as a towel to absorb perspiration and other liquids and having a shammy and a plurality of apertures that pass through the shammy, each of the plurality of apertures comprising a grommet, wherein the elastic towel device is sized and configured as a seat;

b. the one or more elastic bands, each providing an increasing resistance as the band is extended and comprising a first end that passes through one of the plurality of apertures, wherein each of the one or more bands extends from an end of the towel device; and c. one or more handles separate and distinct from the one or more elastic bands and attached at a second end opposite the first end of the one or more elastic bands and the one or more bands for performing exercises by extending and retracting the one or more bands with the one or more handles, wherein the one or more elastic bands are extended and retracted when the towel-band exercise device is laid flat on a surface and weight is placed on the towel-band exercise device.

* * * * *